US007857602B2

(12) United States Patent
Morimoto et al.

(10) Patent No.: US 7,857,602 B2
(45) Date of Patent: Dec. 28, 2010

(54) MUFFLER INSTALLATION STRUCTURE FOR COMPRESSOR

(75) Inventors: Kouki Morimoto, Kusatsu (JP); Hiroki Kamiishida, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 908 days.

(21) Appl. No.: 11/666,856

(22) PCT Filed: Nov. 2, 2005

(86) PCT No.: PCT/JP2005/020227

§ 371 (c)(1),
(2), (4) Date: May 3, 2007

(87) PCT Pub. No.: WO2006/049219

PCT Pub. Date: May 11, 2006

(65) Prior Publication Data

US 2007/0292284 A1 Dec. 20, 2007

(30) Foreign Application Priority Data

Nov. 4, 2004 (JP) ..... 2004-320486

(51) Int. Cl.
*F04B 53/00* (2006.01)

(52) U.S. Cl. ..... 417/312; 181/403

(58) Field of Classification Search ..... 417/312; 181/403, 212, 224; 277/630, 637
See application file for complete search history.

(56) References Cited

U.S. PATENT DOCUMENTS 4,418,533 A * 12/1983 Folsom ..... 60/520
6,398,520 B2 * 6/2002 Han ..... 417/312

FOREIGN PATENT DOCUMENTS

| | | | |
|---|---|---|---|
| JP | 55-100085 | U | 7/1980 |
| JP | 56-63888 | U | 5/1981 |
| JP | 58-27583 | U | 2/1983 |
| JP | 58-79089 | U | 5/1983 |
| JP | 59-175689 | U | 11/1984 |
| JP | 62-135694 | A | 6/1987 |
| JP | 62-210284 | A | 9/1987 |
| JP | 02-086991 | A | 3/1990 |
| JP | 03-51197 | U | 5/1991 |
| JP | 05-223085 | A | 8/1993 |
| JP | 06-002689 | A | 1/1994 |

* cited by examiner

*Primary Examiner*—Devon C Kramer
*Assistant Examiner*—Philip Stimpert
(74) *Attorney, Agent, or Firm*—Global IP Counselors

(57) ABSTRACT

A muffler installation structure for compressors includes an end plate member fitted to an opening end of a cylinder body, a cup-shaped muffler fitted to the end plate member, and a fixing member for fixing the muffler to the end plate member. At places near the fixing member, an inner peripheral surface of a peripheral wall of the muffler and an outer peripheral surface of a body portion of the end plate member are clearance-fitted to each other. At places distant from the fixing member, on the other hand, the inner peripheral surface of the peripheral wall of the muffler and the outer peripheral surface of the body portion of the end plate member are close-fitted.

6 Claims, 7 Drawing Sheets

MUFFLER INSTALLATION STRUCTURE FOR COMPRESSOR

CROSS-REFERENCE TO RELATED APPLICATIONS

This U.S. National stage application claims priority under 35 U.S.C. §119(a) to Japanese Patent Application No. 2004-320486, filed in Japan on Nov. 4, 2004, the entire contents of which are hereby incorporated herein by reference.

TECHNICAL FIELD

The present invention relates to a muffler installation structure for compressors such as a rotary compressor to be used in an air conditioner or the like.

BACKGROUND OF THE INVENTION

As shown in FIG. 6, a conventional muffler installation structure for compressors includes an end plate member 150 fitted to an opening end of a cylinder body 121, a cup-shaped muffler 140 fitted to the end plate member 150, and a fixing member 135 for fixing the muffler 140 to the end plate member 150 (see, e.g., JP 6-2689 A).

The muffler 140 has a peripheral wall 141 fitted to an outer peripheral surface 151*b* of a body portion 151 of the end plate member 150. In a state before the muffler 140 is fitted to the end plate member 150, the outer peripheral surface 151*b* of the body portion 151 of the end plate member 150 is shaped into a generally perfect circle as viewed in the axial direction while an inner peripheral surface 141*a* of the peripheral wall 141 of the muffler 140 is shaped into a generally perfect circle as viewed in the axial direction.

Then, compressed gas in a cylinder chamber 122 of the cylinder body 121 flows inward of the muffler 140 through a discharge hole 151*a* of the body portion 151 of the end plate member 150, and flows outward of the muffler 140 through a gap S between a hole portion 142*a* at a center of the muffler 140 and a boss portion 152 of the end plate member 150.

In this case, there is a need for ensuring sealability between the muffler 140 and the end plate member 150. If the sealability between the muffler 140 and the end plate member 150 cannot be ensured, there are issues (a), (b) and (c) as shown below.

(a) Gas leaks from contact sites between the muffler and the end plate member, causing lubricating oil present inside the compressor to blow up.

(b) Pulsated gas leaks from the contact sites between the muffler and the end plate member, causing occurrence of noise and reduction of the muffling effect.

(c) The contact between the muffler and the end plate member becomes insufficient, so that natural vibrations of the muffler itself are more likely to be excited, causing occurrence of noise.

However, in the prior-art muffler installation structure for compressors described above, since the outer peripheral surface 151*b* of the body portion 151 of the end plate member 150 is shaped into a generally perfect circle as viewed in the axial direction and since the inner peripheral surface 141*a* of the peripheral wall 141 of the muffler 140 is shaped into a generally perfect circle as viewed in the axial direction, there is a need that the diameter of the generally perfect circle of the inner peripheral surface 141*a* of the peripheral wall 141 of the muffler 140 be set close to the diameter of the generally perfect circle of the outer peripheral surface 151*b* of the body portion 151 of the end plate member 150 in order to ensure the sealability between the muffler 140 and the end plate member 150. As a result, there are issues (d) and (e) as shown below.

(d) Compressive load on the end plate member due to elastic deformation of the muffler becomes larger, making it difficult to assemble the muffler and the end plate member together.

(e) Compressive load on the end plate member due to elastic deformation of the muffler becomes larger, causing occurrence of strain to the end plate member so that the assembling accuracy between the muffler and the end plate member degrades.

Thus, the prior-art muffler installation structure for compressors described above is incapable of satisfying improvement of the sealability, improvement of the muffling effect, facilitation of the assembly and improvement of the assembling accuracy at the same time.

SUMMARY OF THE INVENTION

Accordingly, an object of the present invention is to provide a muffler installation structure for compressors which is capable of satisfying improvement of the sealability, improvement of the muffling effect, facilitation of the assembly and improvement of the assembling accuracy at the same time.

In order to achieve the above object, according to the present invention, there is provided a muffler installation structure for compressors, comprising:

an end plate member fitted to an opening end of a cylinder body;

a cup-shaped muffler fitted to the end plate member; and a fixing member for fixing the muffler to the end plate member, wherein the muffler has a peripheral wall which is fitted to an outer peripheral surface of a body portion of the end plate member, and at places near the fixing member, an inner peripheral surface of the peripheral wall of the muffler and the outer peripheral surface of the body portion of the end plate member are clearance-fitted, while at places distant from the fixing member, the inner peripheral surface of the peripheral wall of the muffler and the outer peripheral surface of the body portion of the end plate member are close-fitted to each other.

In this muffler installation structure for compressors according to the invention, since the inner peripheral surface of the peripheral wall of the muffler and the outer peripheral surface of the body portion of the end plate member are clearance-fitted to each other at places near the fixing member, while the inner peripheral surface of the peripheral wall of the muffler and the outer peripheral surface of the body portion of the end plate member are close-fitted to each other at places distant from the fixing member. Therefore, the sealability between the muffler and the end plate member is ensured by the fixing member at places near the fixing member, while the inner peripheral surface of the peripheral wall of the muffler and the outer peripheral surface of the body portion of the end plate member is reliably put into contact with each other at places distant from the fixing member so that the sealability between the muffler and the end plate member is ensured.

Thus, by virtue of a stable contact state between the muffler and the end plate member, there can be obtained effects (A), (B) and (C) shown below.

(A) Gas leaks from contact sites between the muffler and the end plate member are suppressed, so that lubricating oil present inside the compressor can be prevented from blowing up.

(B) Pulsated gas leaks from contact sites between the muffler and the end plate member are suppressed, so that occurrence of noise can be prevented and the muffling effect can be improved.

(C) The contact between the muffler and the end plate member can reliably be achieved, so that excitation of natural vibrations of the muffler itself can be prevented and occurrence of noise can be prevented.

Furthermore, since the inner peripheral surface of the peripheral wall of the muffler and the outer peripheral surface of the body portion of the end plate member are fitted to each other by clearance-fit and close-fit, there can be obtained effects (D) and (E) shown below.

(D) Compressive load on the end plate member due to elastic deformation of the muffler becomes smaller, so that the assembly of the muffler and the end plate member is facilitated.

(E) Compressive load on the end plate member due to elastic deformation of the muffler becomes smaller, so that occurrence of strain to the end plate member is suppressed and the assembling accuracy between the muffler and the end plate member is improved.

Thus, it becomes possible to satisfy improvement of the sealability, improvement of the muffling effect, facilitation of the assembly and improvement of the assembling accuracy at the same time.

In an embodiment, the muffler is fixed in contact to an end face of the body portion of the end plate member by the fixing member.

In this embodiment, since the muffler is fixed in contact to the end face of the body portion of the end plate member by the fixing member, sealability of the muffler is ensured by its contact with the end face of the body portion of the end plate member at places near the fixing member, so that gas leaks can reliably be prevented.

In an embodiment, the peripheral wall of the muffler is fixed in contact to the outer peripheral surface of the body portion of the end plate member by the fixing member.

In the muffler installation structure for compressors in this embodiment, since the peripheral wall of the muffler is fixed in contact to the outer peripheral surface of the body portion of the end plate member by the fixing member, the muffler can be formed into a simple cup-shape, thus the formation of the muffler being simply achievable.

In an embodiment, in a state before the muffler is fitted to the end plate member, the outer peripheral surface of the body portion of the end plate member is shaped into a generally perfect circle as viewed in an axial direction, the inner peripheral surface of the peripheral wall of the muffler is shaped into a generally-defined ellipse as viewed in the axial direction, a major axis of the generally-defined ellipse of the inner peripheral surface of the peripheral wall of the muffler is larger than a diameter of the generally perfect circle of the outer peripheral surface of the body portion of the end plate member, and a minor axis of the generally-defined ellipse of the inner peripheral surface of the peripheral wall of the muffler is smaller than the diameter of the generally perfect circle of the outer peripheral surface of the body portion of the end plate member.

In this embodiment, since the outer peripheral surface of the body portion of the end plate member is shaped into a generally perfect circle as viewed in the axial direction while the inner peripheral surface of the peripheral wall of the muffler is shaped into a generally-defined ellipse as viewed in the axial direction, a clearance-fit is implemented in the direction of the major axis of the generally-defined ellipse of the inner peripheral surface of the peripheral wall of the muffler while a close-fit is implemented in the direction of the minor axis of the generally-defined ellipse of the inner peripheral surface of the peripheral wall of the muffler. Thus, clearance-fit and close-fit between the end plate member and the muffler can be fulfilled by the end plate member and the muffler of simple shapes.

In an embodiment, in a state before the muffler is fitted to the end plate member, the outer peripheral surface of the body portion of the end plate member is shaped into a generally-defined ellipse as viewed in an axial direction, the inner peripheral surface of the peripheral wall of the muffler is shaped into a generally perfect circle as viewed in the axial direction, a major axis of the generally-defined ellipse of the outer peripheral surface of the body portion of the end plate member is larger than a diameter of the generally perfect circle of the inner peripheral surface of the peripheral wall of the muffler, and a minor axis of the generally-defined ellipse of the outer peripheral surface of the body portion of the end plate member is smaller than the diameter of the generally perfect circle of the inner peripheral surface of the peripheral wall of the muffler.

In this embodiment, since the outer peripheral surface of the body portion of the end plate member is shaped into a generally-defined ellipse as viewed in the axial direction while the inner peripheral surface of the peripheral wall of the muffler is shaped into a generally perfect circle as viewed in the axial direction, a clearance-fit is implemented in the direction of the minor axis of the generally-defined ellipse of the outer peripheral surface of the body portion of the end plate member while a close-fit is implemented in the direction of the major axis of the generally-defined ellipse of the outer peripheral surface of the body portion of the end plate member. Thus, clearance-fit and close-fit between the end plate member and the muffler can be fulfilled by the end plate member and the muffler of simple shapes.

DETAILED DESCRIPTION OF THE INVENTION

Hereinbelow, the present invention will be described in detail by embodiments thereof illustrated in the accompanying drawings.

First Embodiment

Figure 1:
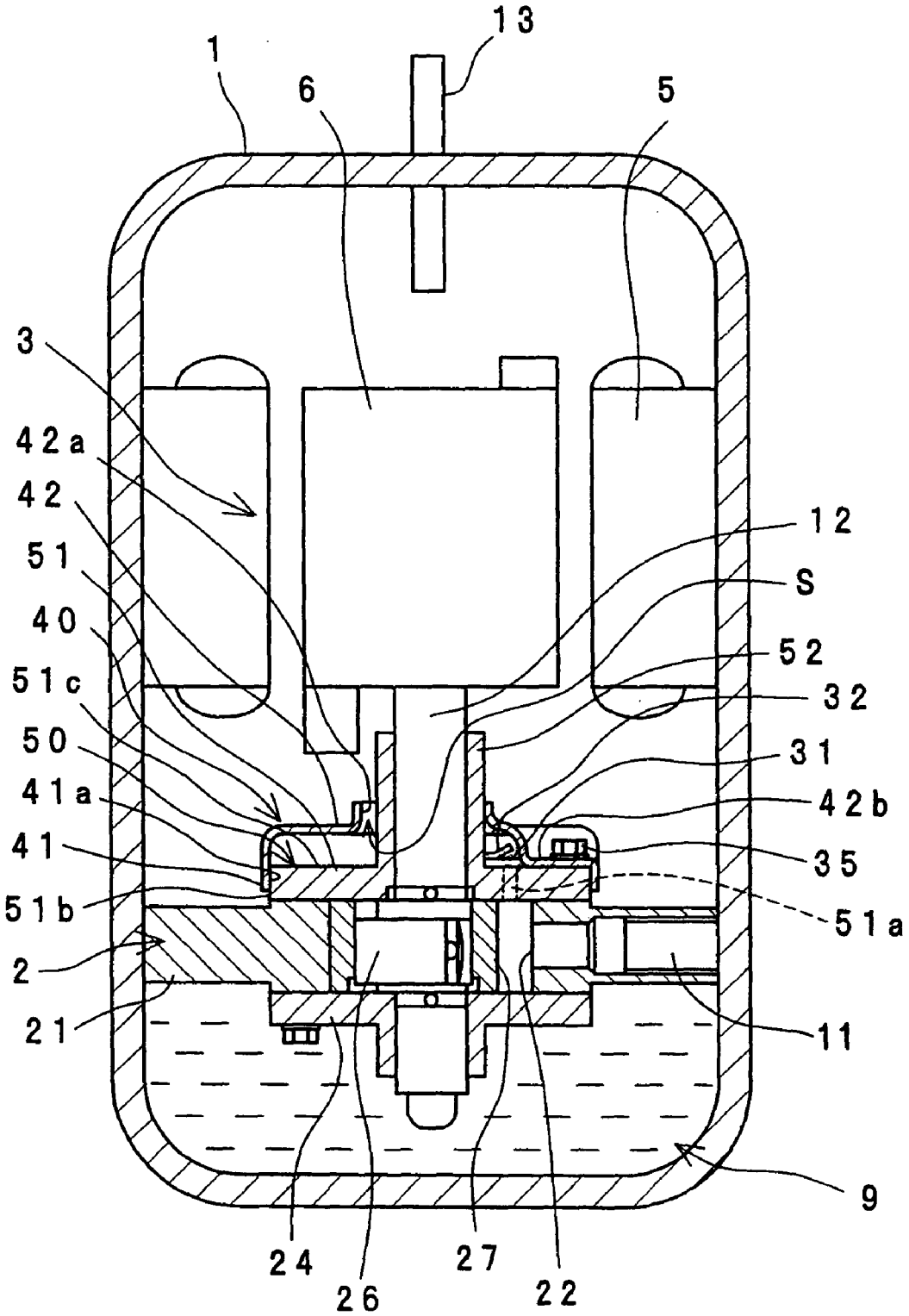
FIG. 1 is a sectional view showing an embodiment of a muffler installation structure for compressors according to the present invention.

FIG. 1 shows a sectional view of an embodiment of a muffler installation structure for compressors according to the present invention. This compressor, which is a so-called high-pressure dome type rotary compressor, has a compression section 2 placed below and a motor 3 placed above in a casing 1. The compression section 2 is driven via a drive shaft 12 by a rotor 6 of the motor 3.

The compression section 2 sucks up a refrigerant gas from an unshown accumulator through a suction passage 11. The refrigerant gas can be obtained by controlling unshown condenser, expansion mechanism and evaporator which are used with the compressor to constitute an air conditioner as an example of refrigeration systems.

The compressor discharges high-temperature, high-pressure compressed discharge gas from the compression section 2 to make the casing 1 filled therewith, and cools the motor 3 through a gap between a stator 5 and the rotor 6 of the motor 3, thus discharging the gas outside through a discharge pipe 13. Lubricating oil 9 is accumulated at a lower portion of the high-pressure region within the casing 1.

Figure 2:
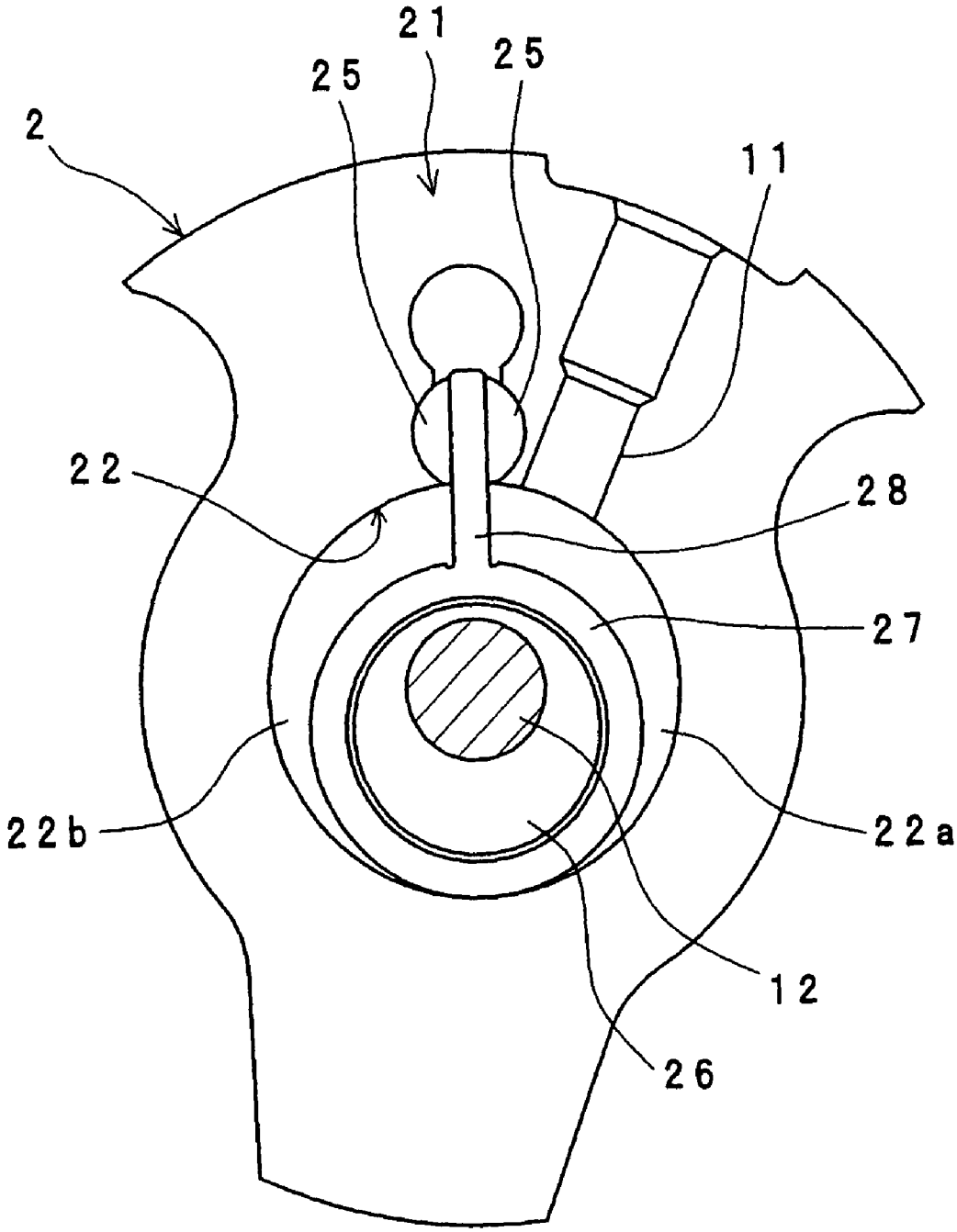
FIG. 2 is a plan view of main part of the compressor.

As shown in FIGS. 1 and 2, the compression section 2 includes a cylinder body 21 forming a cylinder chamber 22, and an upper end plate member 50 and a lower end plate member 24 which are fitted at upper and lower opening ends, respectively, of the cylinder body 21 to cover the cylinder chamber 22.

The drive shaft 12 extends through the upper end plate member 50 and the lower end plate member 24 and enters inside the cylinder chamber 22.

A roller 27 fitted to a crankpin 26 provided on the drive shaft 12 is revolvably placed in the cylinder chamber 22 so that compression action is exerted by revolutionary motion of the roller 27.

The interior of the cylinder chamber 22 is partitioned by a blade 28 formed integrally with the roller 27. That is, as shown in FIG. 2, in a chamber on the right side of the blade 28, a suction passage 11 opens in an inner surface of the cylinder chamber 22 to form a suction chamber 22*a*. On the other hand, in a chamber on the left side of the blade 28, a discharge hole 51*a* shown in FIG. 1 opens in the inner surface of the cylinder chamber 22 to form a discharge chamber 22*b*.

Semicircular bushes 25, 25 are set in close contact with both surfaces of the blade 28 to make a sealing. Lubrication between the blade 28 and the bushes 25, 25 is done with the lubricating oil 9.

Then, as the crankpin 26 is eccentrically rotated along with the drive shaft 12, the roller 27 fitted to the crankpin 26 is revolved with an outer peripheral surface of the roller 27 kept in contact with an inner peripheral surface of the cylinder chamber 22.

Along with the revolution of the roller 27 in the cylinder chamber 22, the blade 28 is moved back and forth with both side faces of the blade 28 held by the bushes 25, 25. Then, the low-pressure refrigerant is sucked into the suction chamber 22*a* through the suction passage 11, being compressed in the discharge chamber 22*b* into a higher pressure. Thereafter, the high-pressure refrigerant is discharged through the discharge hole 51*a*.

Figure 3A:
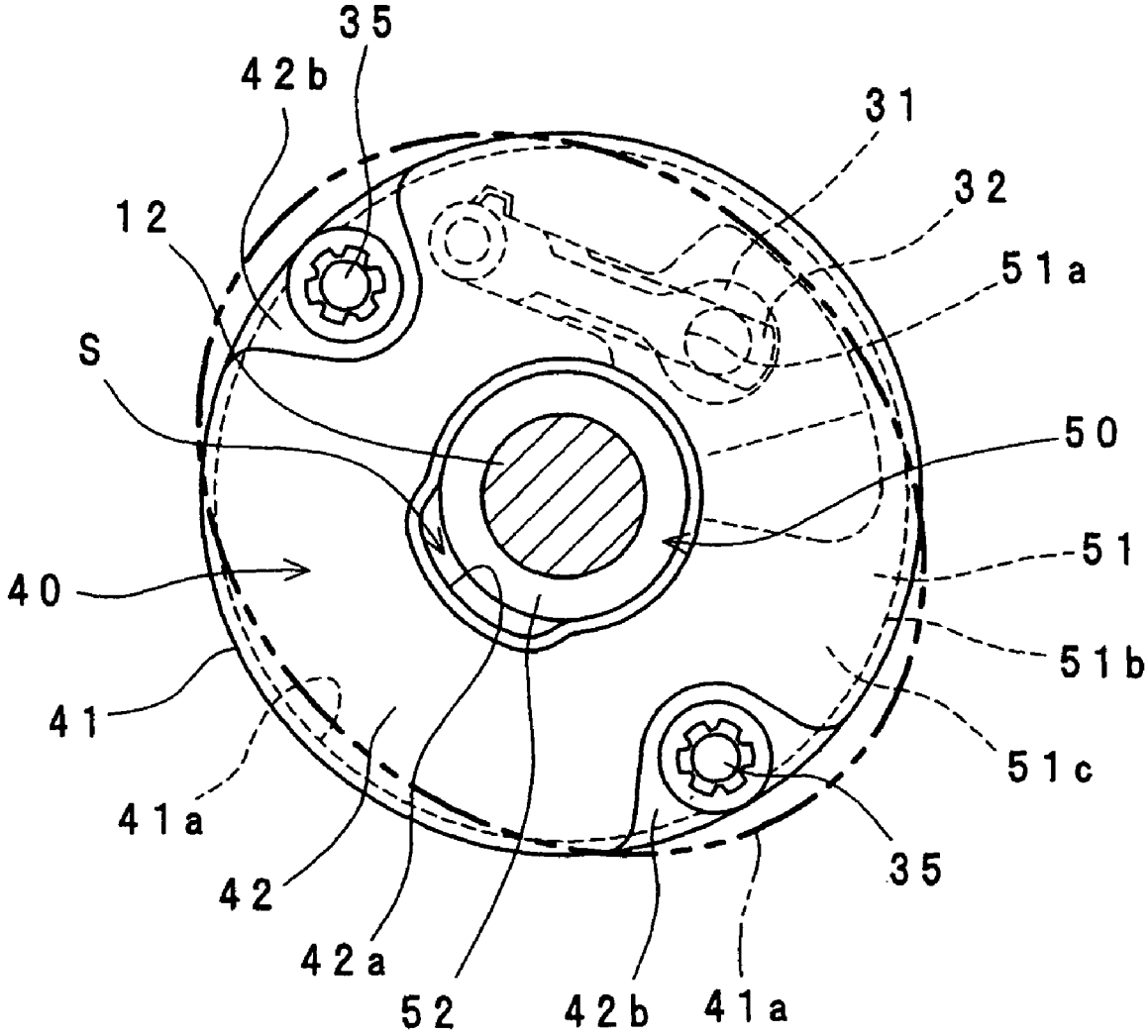
FIG. 3A is a plan view of the muffler installation structure.

As shown in FIGS. 1 and 3A, the upper end plate member 50 (hereinafter, referred to simply as end plate member 50) has a disc-shaped body portion 51 and a boss portion 52 provided upward at a center of the body portion 51.

The drive shaft 12 is inserted in the body portion 51 and the boss portion 52. In the body portion 51, the discharge hole 51*a* is provided so as to communicate with the cylinder chamber 22.

A plate-shaped discharge valve 31 and a plate-shaped valve guard member 32 are provided on an end face 51*c* of the body portion 51 located on one side axially opposite to the side on which the cylinder body 21 is provided. In response to the pressure of the refrigerant (compressed gas) inside the cylinder chamber 22, one end side of the discharge valve 31 is elastically deformed to open and close the discharge hole 51*a*. The valve guard member 32 cooperates with the end plate member 50 to pinch the other end side of the discharge valve 31. The valve guard member 32 suppresses the motion of the discharge valve 31 so that one end side of the discharge valve 31 is not deformed (swung) to more than necessary extents.

A cup-shaped muffler 40 is fitted to the end plate member 50 so as to cover the end face 51*c* of the body portion 51. The muffler 40 has a top wall 42 generally parallel to the end face 51*c* of the body portion 51, and a peripheral wall 41 provided downward around the top wall 42.

A hole portion 42*a* is provided at a center of the top wall 42 of the muffler 40, and the boss portion 52 of the end plate member 50 is inserted into the hole portion 42*a*. A gap S is provided between the inner peripheral surface of the hole portion 42*a* and the outer peripheral surface of the boss portion 52. The gap S is located at a position symmetrical to the discharge hole 51*a* with the axis of the drive shaft 12 taken as a center.

The peripheral wall 41 of the muffler 40 is fitted to an outer peripheral surface 51*b* of the body portion 51 of the end plate member 50. The muffler 40 is fixed in contact to the end face 51*c* of the body portion 51 of the end plate member 50 by fixing members 35 (e.g., bolts).

More specifically, the top wall 42 of the muffler 40 has recess portions 42*b* recessed toward the opening of the muffler 40. The recess portions 42*b* are provided two in number in proximity to the peripheral wall 41 at symmetrical positions with respect to the axis of the drive shaft 12. That is, the top wall 42 is formed into a gourd shape as viewed in the axial direction.

The fixing member 35 is placed at the recess portions 42*b*, and tightening the fixing member 35 causes the recess portions 42*b* to be put into close contact with the end face 51*c* of the body portion 51 of the end plate member 50.

Then, the compressed gas in the cylinder chamber 22 flows inward of the muffler 40 through the discharge hole 51*a* of the body portion 51 of the end plate member 50, and flows outward of the muffler 40 through the gap S between the muffler 40 and the end plate member 50.

At places near the fixing member 35, an inner peripheral surface 41*a* of the peripheral wall 41 of the muffler 40 and the outer peripheral surface 51*b* of the body portion 51 of the end plate member 50 are clearance-fitted to each other. At places distant from the fixing member 35, on the other hand, the inner peripheral surface 41*a* of the peripheral wall 41 of the muffler 40 and the outer peripheral surface 51*b* of the body portion 51 of the end plate member 50 are close-fitted to each other.

More specifically, in a state before the muffler 40 is fitted to the end plate member 50, the outer peripheral surface 51*b* of the body portion 51 of the end plate member 50 is shaped into a generally perfect circle as viewed in the axial direction. On the other hand, as shown by imaginary lines in FIG. 3A, the inner peripheral surface 41*a* of the peripheral wall 41 of the muffler 40 is shaped into a generally-defined ellipse as viewed in the axial direction.

Figure 3B:
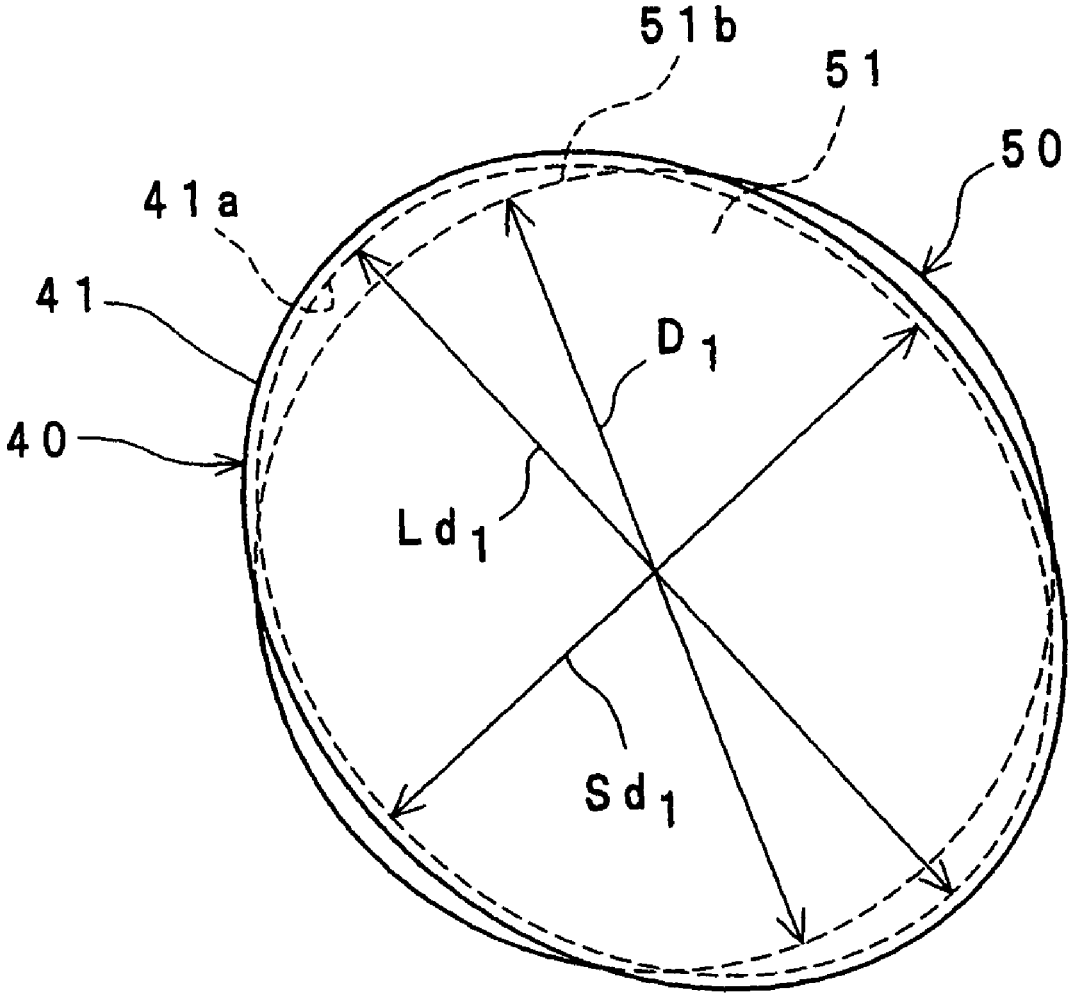
FIG. 3B is a simplified plan view showing a relationship between an end plate member and a muffler in a state before the muffler is fitted to the end plate member.

That is, as shown in FIG. 3B, a major axis $Ld_1$ of the generally-defined ellipse of the inner peripheral surface 41*a* of the peripheral wall 41 of the muffler 40 is larger than a diameter $D_1$ of the generally perfect circle of the outer peripheral surface 51*b* of the body portion 51 of the end plate member 50. On the other hand, a minor axis $Sd_1$ of the generally-defined ellipse of the inner peripheral surface 41*a* of the peripheral wall 41 of the muffler 40 is smaller than the diameter $D_1$ of the generally perfect circle of the outer peripheral surface 51*b* of the body portion 51 of the end plate member 50.

According to the muffler installation structure for compressors as described above, the inner peripheral surface 41*a* of the peripheral wall 41 of the muffler 40 and the outer peripheral surface 51*b* of the body portion 51 of the end plate member 50 are clearance-fitted to each other at places near the fixing member 35, while the inner peripheral surface 41*a* of the peripheral wall 41 of the muffler 40 and the outer peripheral surface 51*b* of the body portion 51 of the end plate member 50 are close-fitted to each other at places distant from the fixing member 35. Therefore, the sealability between the muffler 40 and the end plate member 50 can be ensured by the fixing member 35 at places near the fixing member 35, while the inner peripheral surface 41*a* of the peripheral wall 41 of the muffler 40 and the outer peripheral surface 51*b* of the body portion 51 of the end plate member 50 can reliably be put into contact with each other at places distant from the fixing member 35 so that the sealability between the muffler 40 and the end plate member 50 can be ensured.

Thus, by virtue of a stable contact state between the muffler 40 and the end plate member 50, there can be obtained effects (A), (B) and (C) shown below.

(A) Gas leaks from contact sites between the muffler 40 and the end plate member 50 are suppressed, so that lubricating oil 9 present inside the compressor can be prevented from blowing up.

(B) Pulsated gas leaks from contact sites between the muffler 40 and the end plate member 50 are suppressed, so that occurrence of noise can be prevented and the muffling effect can be improved.

(C) The contact between the muffler 40 and the end plate member 50 can reliably be achieved, so that excitation of natural vibrations of the muffler 40 itself can be prevented and occurrence of noise can be prevented.

Furthermore, since the inner peripheral surface 41*a* of the peripheral wall 41 of the muffler 40 and the outer peripheral surface 51*b* of the body portion 51 of the end plate member 50 are fitted to each other by clearance-fit and close-fit, there can be obtained effects (D) and (E) shown below.

(D) Compressive load on the end plate member 50 due to elastic deformation of the muffler 40 becomes smaller, so that the assembly of the muffler 40 and the end plate member 50 is facilitated.

(E) Compressive load on the end plate member 50 due to elastic deformation of the muffler 40 becomes smaller, so that occurrence of strain to the end plate member 50 is suppressed and the assembling accuracy between the muffler 40 and the end plate member 50 is improved.

Thus, it becomes possible to satisfy improvement of the sealability, improvement of the muffling effect, facilitation of the assembly and improvement of the assembling accuracy at the same time.

In this embodiment, since the muffler 40 is fixed in contact to the end face 51*c* of the body portion 51 of the end plate member 50 by the fixing members 35, sealability of the muffler 40 is ensured by its contact with the end face 51*c* of the body portion 51 of the end plate member 50 at places near the fixing members 35, so that gas leaks can reliably be prevented.

Since the outer peripheral surface 51*b* of the body portion 51 of the end plate member 50 is shaped into a generally perfect circle as viewed in the axial direction while the inner peripheral surface 41*a* of the peripheral wall 41 of the muffler 40 is shaped into a generally-defined ellipse as viewed in the axial direction, a clearance-fit is implemented in the direction of the major axis $Ld_1$ of the generally-defined ellipse of the inner peripheral surface 41*a* of the peripheral wall 41 of the muffler 40 while a close-fit is implemented in the direction of the minor axis $Sd_1$ of the generally-defined ellipse of the inner peripheral surface 41*a* of the peripheral wall 41 of the muffler 40. Thus, clearance-fit and close-fit between the end plate member 50 and the muffler 40 can be fulfilled by the end plate member 50 and the muffler 40 of simple shapes.

Second Embodiment

Figure 4:
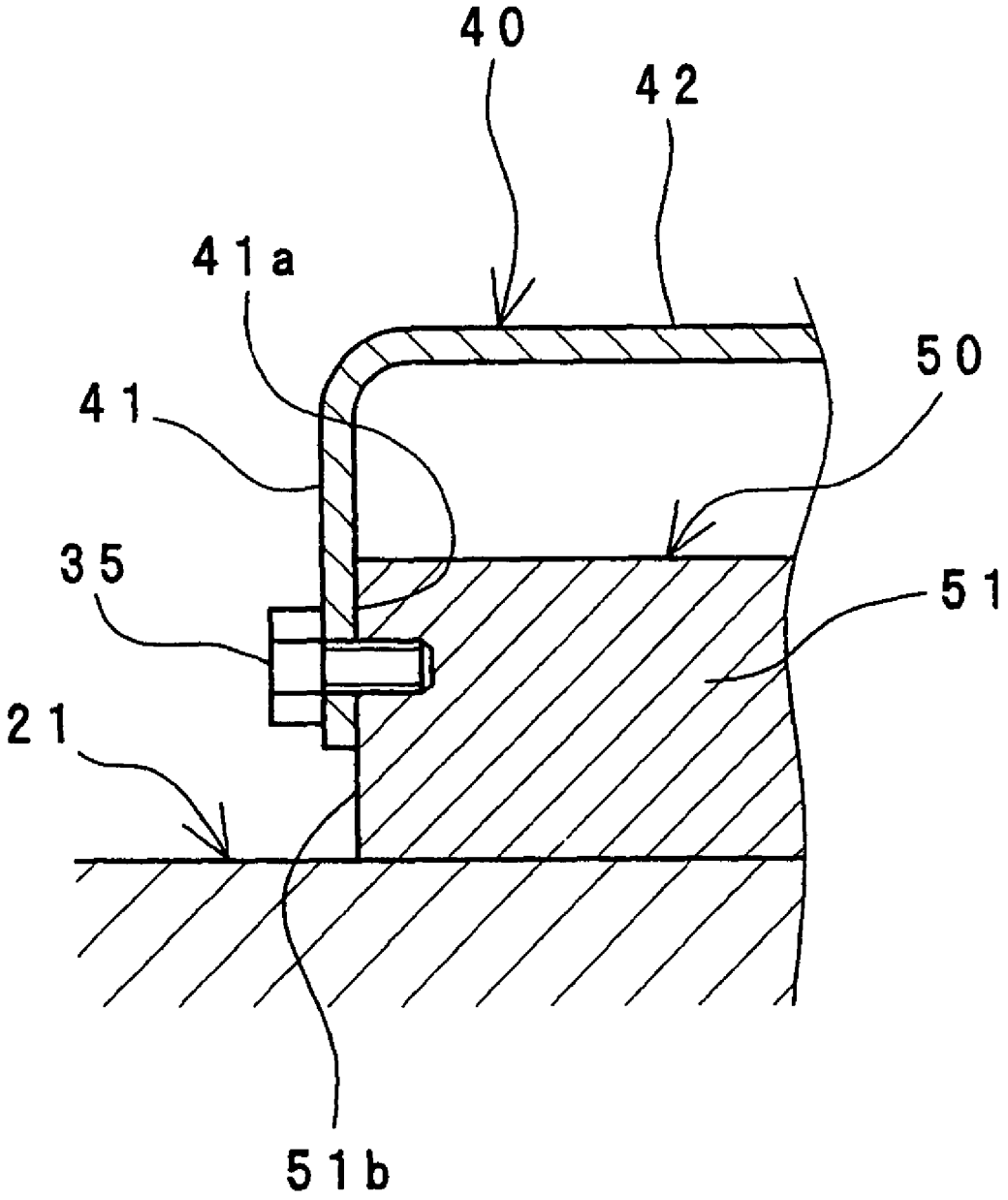
FIG. 4 is a main-part enlarged sectional view showing another embodiment of a muffler installation structure for compressors according to the invention.

FIG. 4 shows another embodiment of the present invention. Its differences from the first embodiment shown in FIG. 1 are described below.

In the second embodiment of FIG. 4, a peripheral wall 41 of a muffler 40 is fixed in contact to an outer peripheral surface 51*b* of a body portion 51 of the end plate member 50 by a fixing member 35. That is, an inner peripheral surface 41*a* of the peripheral wall 41 of the muffler 40 and the outer peripheral surface 51*b* of the body portion 51 of the end plate member 50 are in close contact with each other by the tightening of the fixing member 35.

Thus, since the peripheral wall 41 of the muffler 40 is fixed in contact to the outer peripheral surface 51*b* of the body portion 51 of the end plate member 50 by the fixing member 35, the muffler 40 can be formed into a simple cup shape, thus the formation of the muffler 40 being simply achievable.

Third Embodiment

Figure 5:
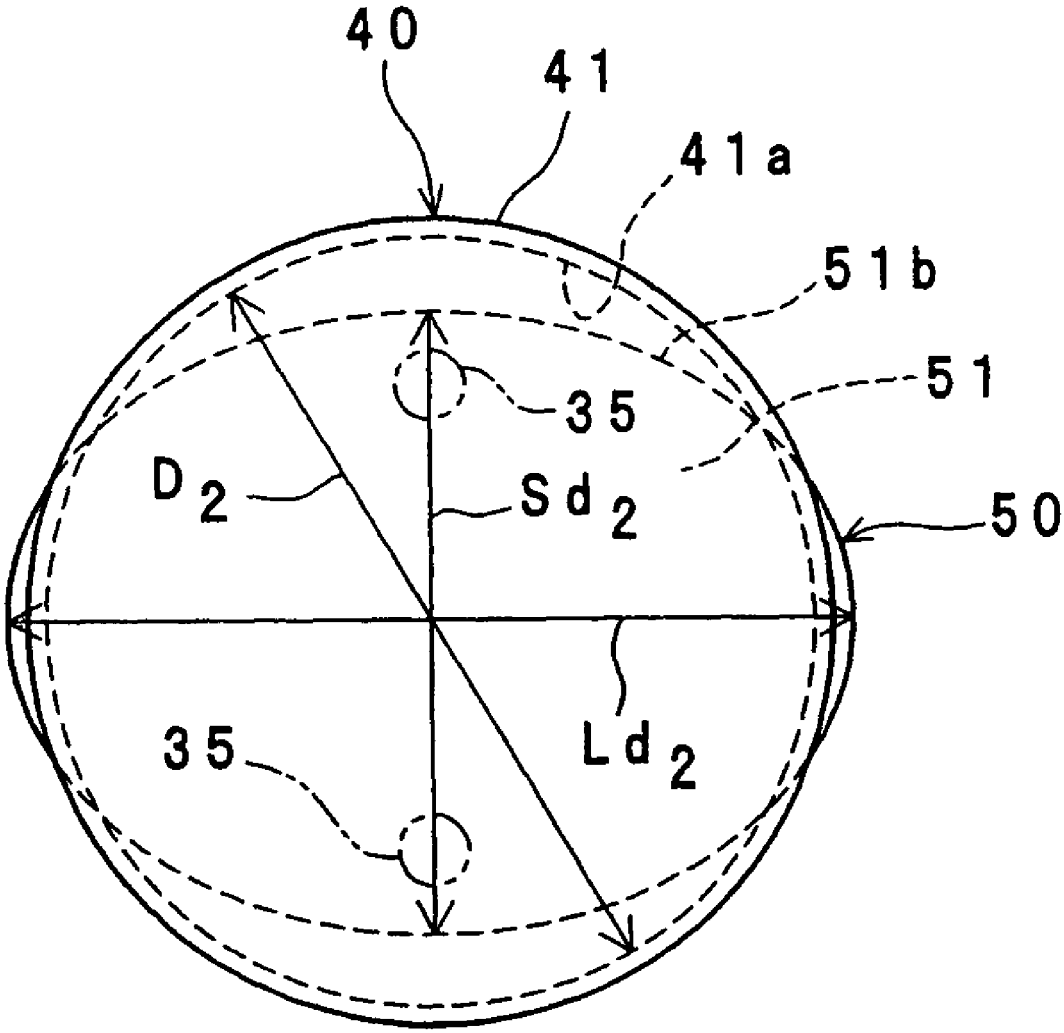
FIG. 5 is a simplified plan view showing another embodiment of a muffler installation structure for compressors according to the invention.
Figure 6:
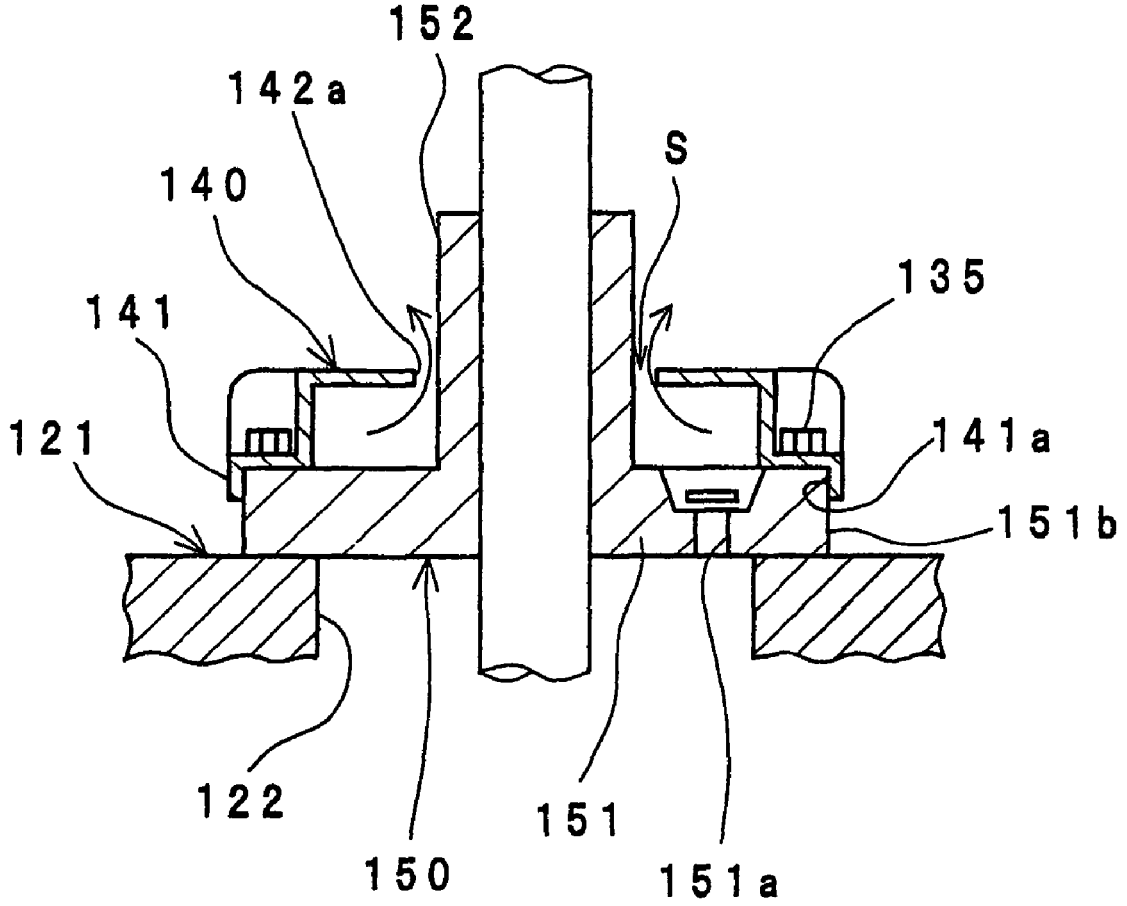
Fig.6 PRIOR ART
FIG. 6 is a sectional view showing a muffler installation structure for compressors according to a prior art.

FIG. 5 shows another embodiment of the present invention. Its differences from the first embodiment shown in FIG. 3B are described below.

In the third embodiment of FIG. 5, in a state before a muffler 40 is fitted to an end plate member 50, an outer peripheral surface 51*b* of a body portion 51 of the end plate member 50 is shaped into a generally-defined ellipse as viewed in the axial direction, and an inner peripheral surface 41*a* of a peripheral wall 41 of a muffler 40 is shaped into a generally perfect circle as viewed in the axial direction.

That is, a major axis $Ld_2$ of the generally-defined ellipse of the outer peripheral surface 51*b* of the body portion 51 of the end plate member 50 is larger than a diameter $D_2$ of the generally perfect circle of the inner peripheral surface 41*a* of the peripheral wall 41 of the muffler 40, and a minor axis $Sd_2$ of the outer peripheral surface 51*b* of the body portion 51 of the end plate member 50 is smaller than the diameter $D_2$ of the generally perfect circle of the inner peripheral surface 41*a* of the peripheral wall 41 of the muffler 40.

Then, a clearance-fit is implemented in the direction of the minor axis $Sd_2$ of the generally-defined ellipse of the outer peripheral surface 51*b* of the body portion 51 of the end plate member 50, while a close-fit is implemented in the direction of the major axis $Ld_2$ of the generally-defined ellipse of the outer peripheral surface 51*b* of the body portion 51 of the end plate member 50. That is, the fixing member 35 is placed along the minor axis $Sd_2$ of the generally-defined ellipse of the outer peripheral surface 51*b* of the body portion 51 of the end plate member 50.

Thus, clearance-fit and close-fit between the end plate member 50 and the muffler 40 can be fulfilled by the end plate member 50 and the muffler 40 of simple shapes.

It is noted that the present invention is not limited to the above-described embodiments. For example, the number of the fixing members 35 may be increased or decreased. Also, the muffler installation structure according to the invention may be applied to displacement type compressors or the like other than swing compressors. Further, position and shape of the gap S of the muffler 40 or the like are not limited to those of the above embodiments and, for example, the gap may be provided over the entire outer peripheral surface of the boss portion 52.

What is claimed is:

1. A muffler installation structure for compressors comprising:

an end plate member fitted to an opening end of a cylinder body;

a cup-shaped muffler fitted to the end plate member; and a fixing member for fixing the muffler to the end plate member, the muffler having a peripheral wall which is fitted to an outer peripheral surface of a body portion of the end plate member, at places near the fixing member, an inner peripheral surface of the peripheral wall of the muffler and the outer peripheral surface of the body portion of the end plate member being clearance-fitted, while at places distant from the fixing member, the inner peripheral surface of the peripheral wall of the muffler and the outer peripheral surface of the body portion of the end plate member being close-fitted to each other, in a state before the muffler is fitted to the end plate member, the outer peripheral surface of the body portion of the end plate member being shaped into a generally perfect circle as viewed in an axial direction, the inner peripheral surface of the peripheral wall of the muffler being shaped into a generally-defined ellipse as viewed in the axial direction, a major axis of the generally-defined ellipse of the inner peripheral surface of the peripheral wall of the muffler being larger than a diameter of the generally perfect circle of the outer peripheral surface of the body portion of the end plate member, and a minor axis of the generally-defined ellipse of the inner peripheral surface of the peripheral wall of the muffler being smaller than the diameter of the generally perfect circle of the outer peripheral surface of the body portion of the end plate member.

2. The muffler installation structure for compressors as claimed in claim 1, wherein the muffler is fixed in contact to an end face of the body portion of the end plate member by the fixing member.

3. The muffler installation structure for compressors as claimed in claim 1, wherein the peripheral wall of the muffler is fixed in contact to the outer peripheral surface of the body portion of the end plate member by the fixing member.

4. A muffler installation structure for compressors comprising:

an end plate member fitted to an opening end of a cylinder body;

a cup-shaped muffler fitted to the end plate member; and a fixing member for fixing the muffler to the end plate member, the muffler having a peripheral wall which is fitted to an outer peripheral surface of a body portion of the end plate member, at places near the fixing member, an inner peripheral surface of the peripheral wall of the muffler and the outer peripheral surface of the body portion of the end plate member being clearance-fitted, while at places distant from the fixing member, the inner peripheral surface of the peripheral wall of the muffler and the outer peripheral surface of the body portion of the end plate member being close-fitted to each other, in a state before the muffler is fitted to the end plate member, the outer peripheral surface of the body portion of the end plate member being shaped into a generally-defined ellipse as viewed in an axial direction, the inner peripheral surface of the peripheral wall of the muffler being shaped into a generally perfect circle as viewed in the axial direction, a major axis of the generally-defined ellipse of the outer peripheral surface of the body portion of the end plate member being larger than a diameter of the generally perfect circle of the inner peripheral surface of the peripheral wall of the muffler, and a minor axis of the generally-defined ellipse of the outer peripheral surface of the body portion of the end plate member being smaller than the diameter of the generally perfect circle of the inner peripheral surface of the peripheral wall of the muffler.

5. The muffler installation structure for compressors as claimed in claim 4, wherein the muffler is fixed in contact to an end face of the body portion of the end plate member by the fixing member.

6. The muffler installation structure for compressors as claimed in claim 4, wherein the peripheral wall of the muffler is fixed in contact to the outer peripheral surface of the body portion of the end plate member by the fixing member.

* * * * *